United States Patent [19]

Vriesen

[11] Patent Number: 4,688,291

[45] Date of Patent: Aug. 25, 1987

[54] CHIMNEY CLEANER

[76] Inventor: Francis W. Vriesen, Rte. 1, Box 193 A, Vicksburg, Miss. 39180

[21] Appl. No.: 840,742

[22] Filed: Mar. 18, 1986

[51] Int. Cl.[4] ..... F23J 3/00

[52] U.S. Cl. ..... 15/249; 15/243

[58] Field of Search ..... 15/162, 163, 242, 243, 15/249

[56] References Cited

U.S. PATENT DOCUMENTS 1,320,887 11/1919 Michels, Sr. ..... 15/249

4,483,038 11/1984 Boehland et al. ..... 15/163

*Primary Examiner*—Edward L. Roberts

*Attorney, Agent, or Firm*—Nixon & Vanderhye

[57] ABSTRACT

A simple and effective chimney cleaner includes a weighted disc that is mounted on a strand (such as a chain or cable) which extends over a pulley. The pulley is mounted above the top of the chimney to be cleaned by a clamp surrounding a portion of the chimney. The disc has sufficient weight to break a creosote bridge which may form within the chimney, and is dimensioned so that it fits within the chimney with a clearance between its periphery and the interior of the chimney. A rain cap is mounted above the pulley, and a spark arrester screen is mounted on the rain cap and surrounds the pulley and scraper disc.

11 Claims, 3 Drawing Figures

CHIMNEY CLEANER

BACKGROUND AND SUMMARY OF THE INVENTION

A well known problem with frequent use of fireplaces, wood burning stoves, and other wood burning appliances is the build up of creosote or the like in the gaseous discharge structures extending from the fireplace, wood burning stove, etc. Such discharge structures (which can complete stove pipes, flues, and the like, and are collectively referred to herein by the term "chimney") must be periodically cleaned otherwise a fire hazard may develop, or the wood burning appliance may be rendered inoperable. Typically, cleaning of the chimney is a time consuming and difficult job, requiring the employment of special apparatus which is brought into the building in which the wood burning appliance is located, used, and then removed. Because of the difficulty, cost, and complications associated with conventional chimney cleaning procedures and devices, many times a chimney is cleaned must less frequently than desirable.

According to the present invention a chimney cleaning apparatus is provided which may be used in a manner which is greatly simplified compared to conventional prior art chimney cleaning procedures. Because of the simple nature of the structure according to the invention and its ease of use, it can be expected to be employed to effect chimney cleaning much more frequently than present procedures, resulting in enhanced safety and ease of use of wood burning appliances.

According to the present invention, a simple chimney cleaning apparatus is provided which includes a weighted scraper disc which acts as a scraper means for scraping creosote from the interior of a chimney. The weighted disc is dimensioned so that it will fit inside the chimney with clearance between the disc periphery and the inside wall of the chimney. The disc has sufficient weight so that it can break a creosote bridge which may form in the chimney, and so that it effects positive and quick scraping of creosote from the chimney.

A cable, chain, or like strand is connected at one end thereof to the scraper disc, and passes over a pulley to extend downwardly toward the roof of a house, or a like structure with which the chimney is associated. The pulley is mounted above the chimney so that the scraper disc overlies the chimney and is movable to positions within the chimney to effect cleaning. The pulley is mounted on at least a semi-permanent basis to the chimney by a clamp which surrounds a portion of the chimney and has a pair of upstanding support rods which straddle the pulley.

Support plates are preferably mounted to the support rods and extend upwardly therefrom. The pivot pin for the pulley passes through the support plates, and a rain cap is mounted at the top of the support plates. The rain cap overlies the pulley and scraper disc, and minimizes entry of precipitation into the chimney. A spark arrester means, preferably in the form of a cylindrical screen, is mounted by the cap and extends downwardly therefrom, surrounding the disc and pulley and arresting passage of sparks from the chimney to the surrounding environment.

It is the primary object to provide a simple, efficient, and effective cleaning apparatus which may be readily employed for effecting cleaning of creosote from the chimneys of wood burning appliances. This and other objects of the invention will become clear from an inspection of the detailed description of the invention, and from the appended claims.

DETAILED DESCRIPTION OF THE DRAWINGS

Figure 1:
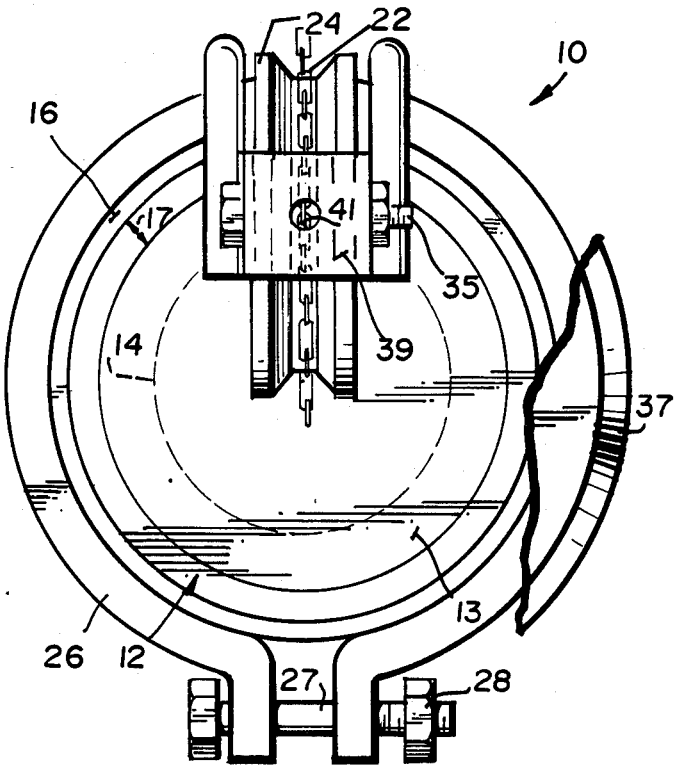
FIG. 1 is a top plan view, with the rain cap and spark arrester removed for clarity of illustration, of an exemplary chimney cleaning apparatus according to the present invention.

An exemplary chimney cleaning apparatus according to the present invention is shown generally by reference numeral 10 in the drawings. A major component of the apparatus 10 comprises the scraper means 12. In the preferred embodiment illustrated, the scraper means is in the form of a weighted disc, having a disc portion 13 which is circular in plan (see FIG. 1) and having a weight 14 integral with and extending downwardly therefrom. The weight 14 has a smaller diameter than the disc 13. The disc 13 is dimensioned so that it fits inside a chimney 16 with which it is utilized, a clearance 17 (see FIGS. 1 and 2) being provided between the periphery of the scraper disc 13 and the interior wall 18 of the chimney. The spacing 17 is exaggerated in the drawings for clarity of illustration, but typically would be on the order of one-quarter inch around the entire circumference of the disc 13. That clearance is sufficient to allow some sideways movement of scraper means 12 as it is moved up and down within the chimney, which facilitates the scraping action and dislodgement of creosote from the interior wall 18 of the chimney 16.

The scraper means 12 preferably is formed of metal, and has sufficient weight so that it effectively performs the scraping action. The weight of scraper means 12 preferably is sufficient so that if the scraper means 12 is moved downwardly into a chimney in which a creosote bridge has formed, the scraper means can break the creosote bridge. While of course the weight is dependent upon the diameter of the disc 13 (and thus the diameter of the chimney 16 with which it is utilized), for a six inch diameter chimney it could typically be between about 2–5 pounds.

A metal eye 20 preferably is integral with the top of the disc 13, extending upwardly therefrom, and provides a mechanism for attachment of a strand to the scraper means 12. In the drawings, the strand is illustrated as a chain 22, but a cable, rope, or other suitable strand could be utilized.

The scraper means 12 is mounted above the chimney 16 for movement from a position (solid line in FIGS. 2 and 3) in which it overlies the chimney, and allows free passage of exhaust gases out of the top of the chimney, to other positions within the chimney 16 (one such position shown in dotted line in FIG. 2) in which it effects scraping of the interior wall 16 of the chimney. Such mounting means preferably takes the form of a pulley 24 over which the strand 22 passes. The pulley is supported above the chimney 16 by a clamp 26, which may be tightened into clamping position, or loosened for removal or replacement of the apparatus 10, by bolt 27 and nut 28. Extending upwardly from the clamp 26 is at least one support arm, and preferably a pair of support rods 29 are provided. Each support rod 29 is attached to the clamp 26 at a first end 30 thereof, while the second ends 31 thereof straddle the pulley 24. Also, a pair of plates 33 preferably are welded, or otherwise attached to, the rods 29, the plates 33 receiving the shaft 35 about which the pulley 24 rotates (the shaft 35 defining a horizontal axis).

In addition to providing a support for the shaft 35 of the pulley 24, the plates 33 also provide support for cap means 37. The cap means 37 minimizes the passage of precipitation into the open top of the chimney 16, and overlies the pulley 24 and scraper means 12. The cap means 37 may be secured to the plates 33 in any suitable manner. For instance the cap 37 may be bolted to a top plate 39 (see FIG. 1) which spans across the tops of the plates 33, the bolt 40 passing into operative association with the screw-threaded hole 41 formed in the plate 39.

A spark arrester means is also preferably provided as part of the apparatus 10. A suitable spark arrester is illustrated schematically by the apparatus with reference numeral 43 in FIG. 3. A spark arrester preferably takes the form of a screen which has a generally cylindrical configuration, being attached to the rain cap 37 (as by deforming it into place with the conical peripheral portion of the rain cap 37), and extends so that it encircles the apparatus 10 from one support rod 29 to the other. The space 45 (see FIG. 2) between the support rods 29 typically would not be covered so that the strand 22 may pass freely between the support rods 29 as the scraper means 12 is moved up and down.

The apparatus 10 according to the present invention is simple and easy to use. Once installed at the top of a chimney 16 it need not be removed again, except if periodic inspection or maintenance is necessary or desirable. The apparatus 10 is mounted on top of the chimney by encircling a top portion of the chimney 16 with the clamp 26, and then tightening nut 28 on bolt 27 so that a firm clamping force is provided holding the clamp in position on the chimney 16 with the support rods 29 extending upwardly therefrom.

To use the apparatus 10, one need only grab a hold of the strand 22 (which preferably extends downwardly from the chimney 16 to approximately ground level) and unhook it from any suitable hook arrangement for holding the strand 22 so that normally the disc 13 is above the chimney 16, allowing free passage of exhaust gases through the chimney. The user then merely allows the scraper means 12 to move downwardly under the force of its own weight into the chimney a sufficient distance, and then pulls on the strand 22 to cause the scraper means 12 to move upwardly in the chimney. By constantly effecting up and down movement of the scraper means 12 within the chimney 16 utilizing the strand 22, the user causes the scraper disc 13 to scrape and impact upon creosote formed on the interior wall 18 of the chimney, causing it to be dislodged and fall down into the fire chamber. If a creosote bridge has formed within the chimney 16, the scraper means 12 has sufficient weight to break the creosote bridge, causing dislodgement of the creosote. When the cleaning operation is completed the user merely pulls on the strand 22 so that the scraper means 12 again moves above the top of the chimney 16 (to the approximate position illustrated in FIGS. 2 and 3), and hooks the strand to retain the scraper means 12 in that position.

Figure 2:
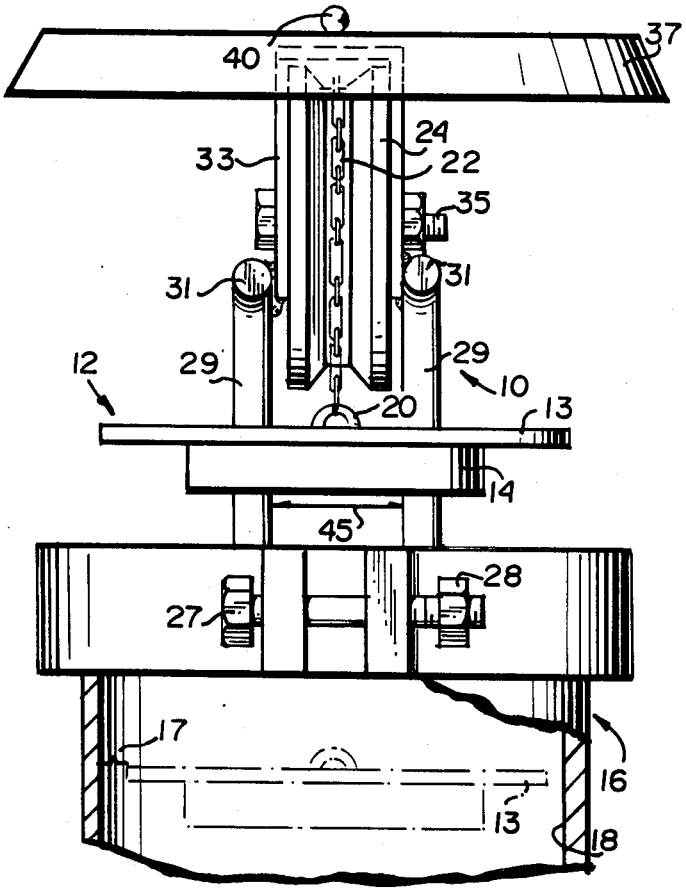
FIG. 2 is a front end view of the apparatus of FIG. 1, and showing a chimney with which it is utilized in cross-section with the scraper within the chimney shown in dotted line.
Figure 3:
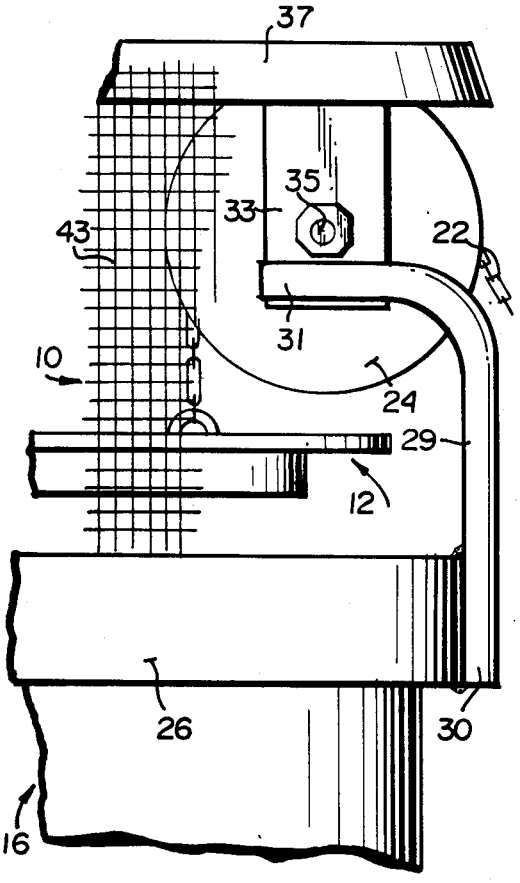
FIG. 3 is a partial side view of the apparatus of FIGS. 1 and 2, showing a portion of the spark arrester which may be associated therewith.

At the end of the heating season, the scraper means 12 may be lowered into the chimney 16 a short distance (one or two inches) to the approximate position illustrated in FIG. 2, and hooks the strand to retain the scraper means 12 in that position thus preventing birds from nesting in the chimney 16 during the non-heating season.

When the heating season begins, the scraper means 12 is first raised to the upper position (as in FIGS. 2 and 3) and secured with the strand and then the heater may be put into operation.

It will thus be seen that according to the present invention a simple and effective apparatus has been provided for cleaning chimneys. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. Cleaning apparatus for cleaning a chimney, comprising:

pulley means;

a strand passing over the pulley means;

scraper means attached to one end of said strand and dimensioned to fit within a chimney with which it is utilized; and means for mounting said pulley means on top of a chimney with which the apparatus is to be utilized, said mounting means comprising a clamp encircling a portion of said chimney, and a pair of support rods each connected at a first end thereof to said clamp and having a second end thereof, said second ends of said rods straddling said pulley; and a pair of plates, one mounted to each of said support rods and extending upwardly therefrom to a position above said pulley; and further comprising cap means mounted by said plates and overlying said pulley means and the chimney, and minimizing entry of precipitation into the chimney, and wherein the scraper means is movable from a first position overlying and spaced from the chimney, to other positions wherein said scraper means is positioned within said chimney and an operator by pulling on and releasing the strand may move said scraper means up and down in the chimney to effect cleaning thereof.

2. Apparatus as recited in claim 1 further comprising spark arrester means supported by said cap means and arresting the emission of sparks from the chimney to the surrounding environment.

3. Apparatus as recited in claim1 wherein said scraper means comprises a weighted disc, said disc having substantially the same plane configuration as the internal cross-section of the chimney, with clearance provided between the periphery of the disc and the interior of the chimney.

4. Apparatus as recited in claim 3 wherein said weighted disc has sufficient weight to break a creosote bridge that may form within the chimney.

5. Apparatus as recited in claim 3 wherein said weighted disc comprises a scraper portion which is circular in plan and has a first diameter, and a weight portion integral with the scraper portion and mounted below the scraper portion, the weight portion having a diameter substantially smaller than the diameter of the scraper portion.

6. Apparatus as recited in claim 3 further comprising spark arrester means comprising a screen extending above and substantially horizontally co-extensively with said mounting means.

7. Apparatus as recited in claim 1 further comprising spark arrester means supported by said cap means and arresting the emission of sparks from the chimney to the surrounding environment.

8. Apparatus as recited in claim 1 further comprising spark arrester means comprising a screen extending above and substantially horizontally co-extensively with said mounting means.

9. Apparatus as recited in claim 1 wherein said strand comprises a chain.

10. Cleaning apparatus for cleaning a chimney comprising:

scraper means comprising a weighted disc dimensioned so that it fits within a chimney with which it is utilized, with clearance being provided between the periphery of the disc and the interior of the chimney, said weighted disc comprising a scraper portion which is circular in plan and has a first diameter, and a weight portion integral with the scraper portion and mounted below the scraper portion, the weight portion having a diameter substantially smaller than the diameter of the scraper portion, and wherein said weighted disc has sufficient weight to break a creosote bridge that may form within the chimney;

means for mounting said disc for movement from a first position in which it overlies the chimney and is spaced therefrom, to other positions in which it is disposed within the chimney and effects cleaning and scraping action on the interior walls of the chimney, said mounting means comprising a clamp adapted to encircle a portion of said chimney;

a pair of support arms, a first vertical portion of each connected to said clamp, and a second, horizontal portion of each connected to an upwardly extending plate; and a pulley rotatably supported between said plates; and means for effecting movement of said disc between the first position thereof, and other positions thereof.

11. Apparatus as recited in claim 10 further comprising cap means mounted by said plates and over said scraper means for minimizing entry of precipitation into the chimney, and a spark arrester operatively connected to said cap means and extending downwardly therefrom and arresting the passage of sparks from the chimney to the surrounding environment.

* * * * *